US011342689B2

(12) United States Patent
Lim et al.

(10) Patent No.: US 11,342,689 B2
(45) Date of Patent: May 24, 2022

(54) MULTI MODE ARRAY ANTENNA

(71) Applicants: Hongik University Industry-Academia Cooperation Foundation, Seoul (KR); Kookmin University Industry Academy Cooperation Foundation, Seoul (KR)

(72) Inventors: Tae Heung Lim, Seoul (KR); Byung-Jun Jang, Seoul (KR); Hosung Choo, Seoul (KR)

(73) Assignees: Hongik University Industry-Academia Cooperation Foundation, Seoul (KR); Kookmin University Industry Academy Cooperation Foundation, Seoul (KR)

( * ) Notice: Subject to any disclaimer, the term of this patent is extended or adjusted under 35 U.S.C. 154(b) by 0 days.

(21) Appl. No.: 16/987,750

(22) Filed: Aug. 7, 2020

(65) Prior Publication Data

US 2021/0044031 A1 Feb. 11, 2021

(30) Foreign Application Priority Data

Aug. 7, 2019 (KR) ..... 10-2019-0095921

(51) Int. Cl.
*H01Q 25/04* (2006.01)
*H01Q 9/32* (2006.01)
*H01Q 9/04* (2006.01)

(52) U.S. Cl.
CPC ..... *H01Q 25/04* (2013.01); *H01Q 9/0464* (2013.01); *H01Q 9/32* (2013.01)

(58) Field of Classification Search
CPC ..... H01Q 25/04; H01Q 9/0485; H01Q 9/0492
See application file for complete search history.

(56) References Cited

U.S. PATENT DOCUMENTS 7,091,917 B2 * 8/2006 Jan ..... H01Q 9/0464 343/700 MS
2016/0149299 A1 5/2016 Yoo et al.
(Continued)

FOREIGN PATENT DOCUMENTS

KR 10-2010-0113938 A 10/2010
KR 10-2013-0087145 A 8/2013
KR 10-2016-0062404 A 6/2016
(Continued)

OTHER PUBLICATIONS

Nathan R. Labadie et al., Multimode Antenna Element with Hemispherical Beam Peak and Null Steering, 2012 IEEE.
(Continued)

*Primary Examiner* — Daniel Munoz
(74) *Attorney, Agent, or Firm* — Jefferson IP Law, LLP

(57) ABSTRACT

The disclosure relates to an array antenna, and more specifically, the array antenna configured by arranging a plurality of antenna elements at close positions. An array antenna is provided. The array antenna includes a first antenna operating in a first mode, and a second antenna operating in a second mode, wherein a correlation between an electric field of the first mode and an electric field of the second mode falls below a first threshold which is predetermined, or a correlation between a magnetic field of the first mode and a magnetic field of the second mode falls below a second threshold which is predetermined.

9 Claims, 25 Drawing Sheets

(56) References Cited

U.S. PATENT DOCUMENTS

| | | | |
|---|---|---|---|
| 2018/0054716 | A1 | 2/2018 | Choi et al. |
| 2019/0393597 | A1 | 12/2019 | Kosaka et al. |

FOREIGN PATENT DOCUMENTS

| | | | |
|---|---|---|---|
| KR | 10-1898634 | B1 | 9/2018 |
| KR | 10-2019-0110508 | A | 9/2019 |
| KR | 10-2019-0112332 | A | 10/2019 |

OTHER PUBLICATIONS

Adam Narbudowicz et al., Switchless Reconfigurable Antenna With 360° Steering, IEEE Antennas and Wireless Propagation Letters, vol. 15, 2016.

Nathan R. Labadie et al., Investigations on the Use of Multiple Unique Radiating Modes for 2-D Beam Steering, IEEE Transactions on Antennas and Propagation, vol. 64, No. 11, Nov. 2016.

Adam Narbudowicz et al., Compact Antenna for Digital Beamforming with Software Defined Radios, 2017 IEEE.

* cited by examiner

MULTI MODE ARRAY ANTENNA

CROSS-REFERENCE TO RELATED APPLICATION(S)

This application is based on and claims priority under 35 U.S.C. § 119(a) of a Korean patent application number 10-2019-0095921, filed on Aug. 7, 2019, in the Korean Intellectual Property Office, the disclosure of which is incorporated by reference herein in its entirety.

BACKGROUND

1. Field

The disclosure relates to an array antenna. More particularly, the disclosure relates to an array antenna configured by arranging a plurality of antenna elements at very close positions.

2. Description of Related Art

In recent, data are exchanged more frequently with an external device using an antenna in a smart phone, a tablet medical device, an Internet of things (IoT) device, and so on, by applying a wireless communication technology. A plurality of antennas is used for wireless fidelity (Wi-Fi), Bluetooth, global positioning system (GPS), and so on, in one device. Using the plurality of the antennas, internal and external signal interference may occur.

In this respect, a technique for nulling or forming an interference signal by use of an array antenna or a technique for mitigating an interference signal by adjusting a weight for each antenna element is widely researched. However, the array antenna including a plurality of an array antenna elements occupies a considerable space, and accordingly there is difficulty in applying it to a device which is getting small.

If the array antenna elements are arranged excessively closely, mutual interference occurs between the array antenna elements and nulling performance may degrade. Such nulling performance degradation is caused by mutual coupling increase between the antennas if a distance between adjacent array antenna elements is very short. In this case, as radiation patterns of the individual elements have high correlations, the pattern nulling or forming performance is degraded and thus spatial diversity of the array antenna also reduces. Hence, what is demanded is a technique for contiguously arranging the array antenna elements and mitigating their interference.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an array antenna, and more specifically, the array antenna configured by arranging a plurality of antenna elements at close positions.

Another aspect of the disclosure is to provide an array antenna of a small size by arranging antenna elements at close positions.

Another aspect of the disclosure is to provide an array antenna for minimizing influence of interference in arranging antenna elements at close positions.

Another aspect of the disclosure is to provide an array antenna having a low coupling pattern correlation in arranging antenna elements at close positions.

Another aspect of the disclosure is to provide an array antenna for having high impedance matching in arranging antenna elements at close positions.

Additional aspects will be set forth in part in the description which follows and, in part, will be apparent from the description, or may be learned by practice of the presented embodiments.

In accordance with an aspect of the disclosure, an array antenna is provided. The array antenna includes a first antenna operating in a first mode, and a second antenna operating in a second mode, wherein a correlation between an electric field of the first mode and an electric field of the second mode falls below a first threshold which is predetermined, or a correlation between a magnetic field of the first mode and a magnetic field of the second mode falls below a second threshold which is predetermined.

The first antenna may be a monopole antenna, and the second antenna may be a patch antenna of a loop shape.

The electric field of the first mode and the electric field of the second mode may be orthogonal, or the magnetic field of the first mode and the magnetic field of the second mode may be orthogonal.

The array antenna may further include a first weight multiplier for multiplying a signal received using the first antenna by a first weight, a second weight multiplier for multiplying a signal received using the second antenna by a second weight, and an array antenna receiver for calculating a received signal of the array antenna by adding the signal multiplied by the first weight and the signal multiplied by the second weight.

The first weight and the second weight may be updated based on Equation 1.

$$\overline{w}_{k+1}=\overline{w}_k-2\cdot\mu\cdot(\overline{r}_{xd})_k+2\cdot\mu\cdot(\overline{R}_{xx})\cdot\overline{w}_k \qquad \text{Equation 1}$$

$\overline{w}_{k+1}$ is a weight vector of a (k+1)-th iterative calculation, $\overline{w}_k$ is a weight vector of a k-th iterative calculation, the weight vector includes, as an element, a weight multiplied by the signal received using each antenna, μ is an adaptive gain value and is a constant greater than 0 and smaller than 1, $(\overline{r}_{xd})_k$ is a cross correlation matrix of a received signal vector $\overline{x}_k$ and a reference signal $d_k$ in the k-th iterative calculation, and $(\overline{R}_{xx})_k$ is a covariance matrix of the received signal vector $\overline{x}_k$ in the k-th iterative calculation.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components and structures.

DETAILED DESCRIPTION

Figure 1A:
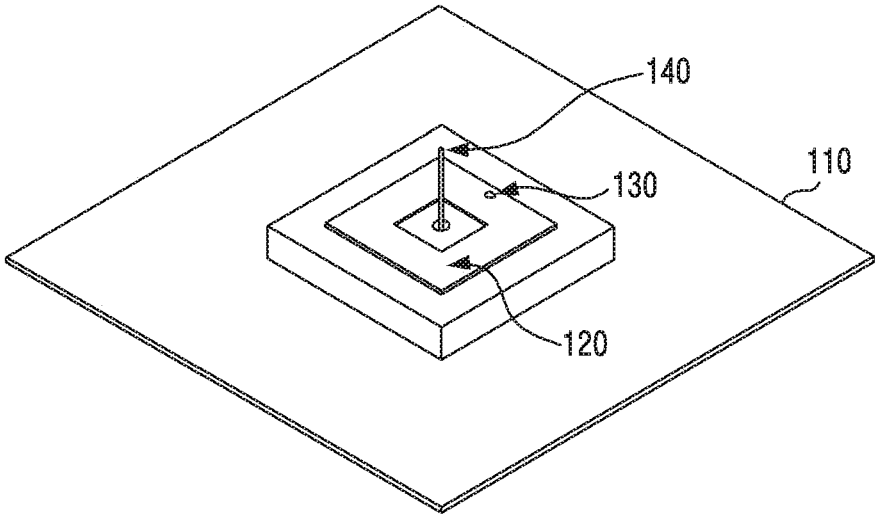
FIG. 1A illustrates an array antenna according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Terms used in the disclosure are used for describing particular embodiments and are not intended to limit the scope of other embodiments. All the terms used herein, including technical and scientific terms, may have the same meanings as terms generally understood by those skilled in the art to which the disclosure pertains. Among terms used in the disclosure, the terms defined in a general dictionary may be interpreted to have the same or similar meanings with the context of the relevant art, and, unless explicitly defined in this disclosure, it shall not be interpreted ideally or excessively as formal meanings. In some cases, even terms defined in this disclosure should not be interpreted to exclude the embodiments of the disclosure.

In various embodiments of the disclosure to be described below, a hardware approach will be described as an example. However, since the various embodiments of the disclosure include a technology using both hardware and software, the various embodiments of the disclosure do not exclude a software-based approach.

Since an array antenna is arranged contiguously and a radiation pattern of individual elements has high correlation, researches are conducted on a technique for minimizing mutual coupling and the pattern correlation of the small array antenna including parasitic element, defected or extended ground planes, electromagnetic band-gap structure and ferrite material use, to address a problem that pattern nulling or forming performance is degraded and spatial diversity of the array antenna also decreases. Such researches may improve insulation and maintain low pattern correlation between adjacent array elements, but may be infeasible in a small device where its space is limited. Hence, researches for mounting the array antenna in the small space have integrated a multi radiation mode of each array element or adopted a different antenna type. However, such researches still need an electric antenna of a great size to achieve a high order mode, and it is hard to control the mutual coupling and the pattern correlation due to a shape of a patch antenna.

To address this problem, the disclosure provides an array antenna, and more specifically, a technique for the array antenna configured by arranging a plurality of antenna elements at very close positions.

The disclosure provides a 2-element array antenna having a very short array distance. Each array element has a modal difference in a radiation pattern, and causes high isolation and low correlation between the arrays.

Terms indicating components of a device, which are used in the following descriptions, are for the sake of explanations. Accordingly, the disclosure is not limited to the terms to be described, and may use other terms having technically identical or similar meaning.

In this disclosure, to determine whether a specific condition is satisfied or fulfilled, expressions such as "greater than" or "less than" are used by way of example and expressions such as "greater than or equal to" or "less than or equal to" are also applicable and not excluded. A condition defined with "greater than or equal to" may be replaced by "greater than" (or vice-versa), and a condition defined with "less than or equal to" may be replaced by "less than" (or vice-versa), etc.

Figure 1B:
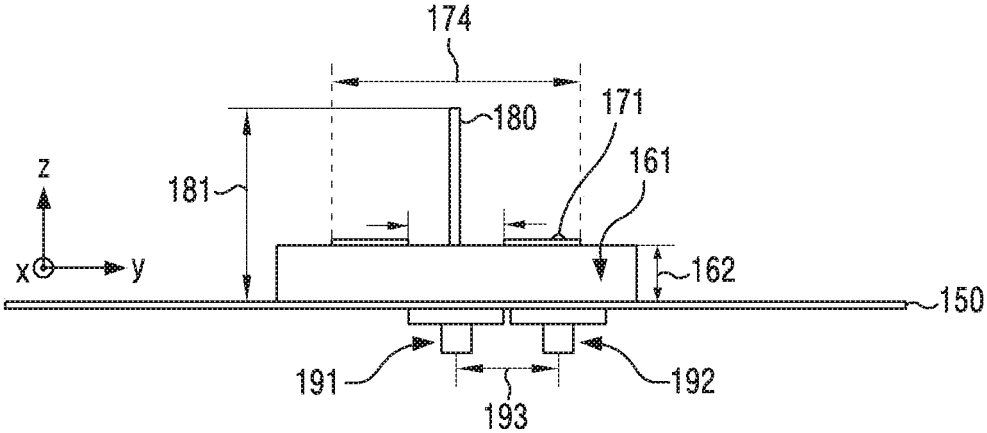
FIG. 1B illustrates an array antenna according to an embodiment of the disclosure.

FIGS. 1A and 1B illustrate an array antenna according to various embodiments of the disclosure.

Referring to FIG. 1A, it illustrates a perspective view of the array antenna according to various embodiments of the disclosure.

The array antenna according to various embodiments of the disclosure may include a first antenna 140 and a second antenna 120. According to various embodiments of the disclosure, a dielectric may be disposed on a substrate 110. The first antenna 140 may be a monopole antenna disposed on the dielectric. The second antenna 120 may be a patch antenna disposed on the substrate 110. Herein, the patch antenna 120 may be a quadrangular loop antenna.

Herein, the loop antenna is rectangular in shape, and includes a shape of different internal and external widths and a rectangular penetrating hole corresponding to the internal width at its center.

FIG. 1B illustrates a side view of the array antenna according to various embodiments of the disclosure. A first antenna 140 and 180 is connected to a first feed port 191 through a dielectric 161 which is a height 162, and receives power using the first feed port 191. The second antenna 120 receives power using a second feed port 192. The second feed port 192 vertically penetrates the dielectric 161 and is connected to a feed point 130 and 171.

Referring to FIG. 1B, a spacing between the first feed port 191 and the second feed port 192 is d 193. A height of the monopole antenna from the substrate 110 and 150 is 1 181.

According to various embodiments of the disclosure, the first antenna 140 may be the monopole antenna which extends vertically to a plane including the patch antenna 120 from the center of the patch antenna which is the second antenna 120.

According to various embodiments of the disclosure, a phase center of the first antenna 140 and a phase center of the second antenna 120 may be in parallel on an axis vertical to the second antenna 120. Since the second antenna 120 is in an x-y plane in FIG. 1B, the phase center of the first antenna 140 and the phase center of the second antenna 120 may be disposed in parallel on a z-axis vertical to the x-y plane.

According to various embodiments of the disclosure, the monopole antenna 140 and the patch antenna 120 of the loop type may share ground.

According to various embodiments of the disclosure, by sharing the ground, the antenna ports may be disposed very closely to each other and minimize distortion of antenna performance.

Referring to FIG. 1A, the antennas may be disposed contiguously, wherein center points of electrical interpretation of the antennas 120 and 140 match. Referring to FIG. 1A, the array antenna may be configured using the antenna elements 140 and 120 disposed contiguously.

Figure 2:
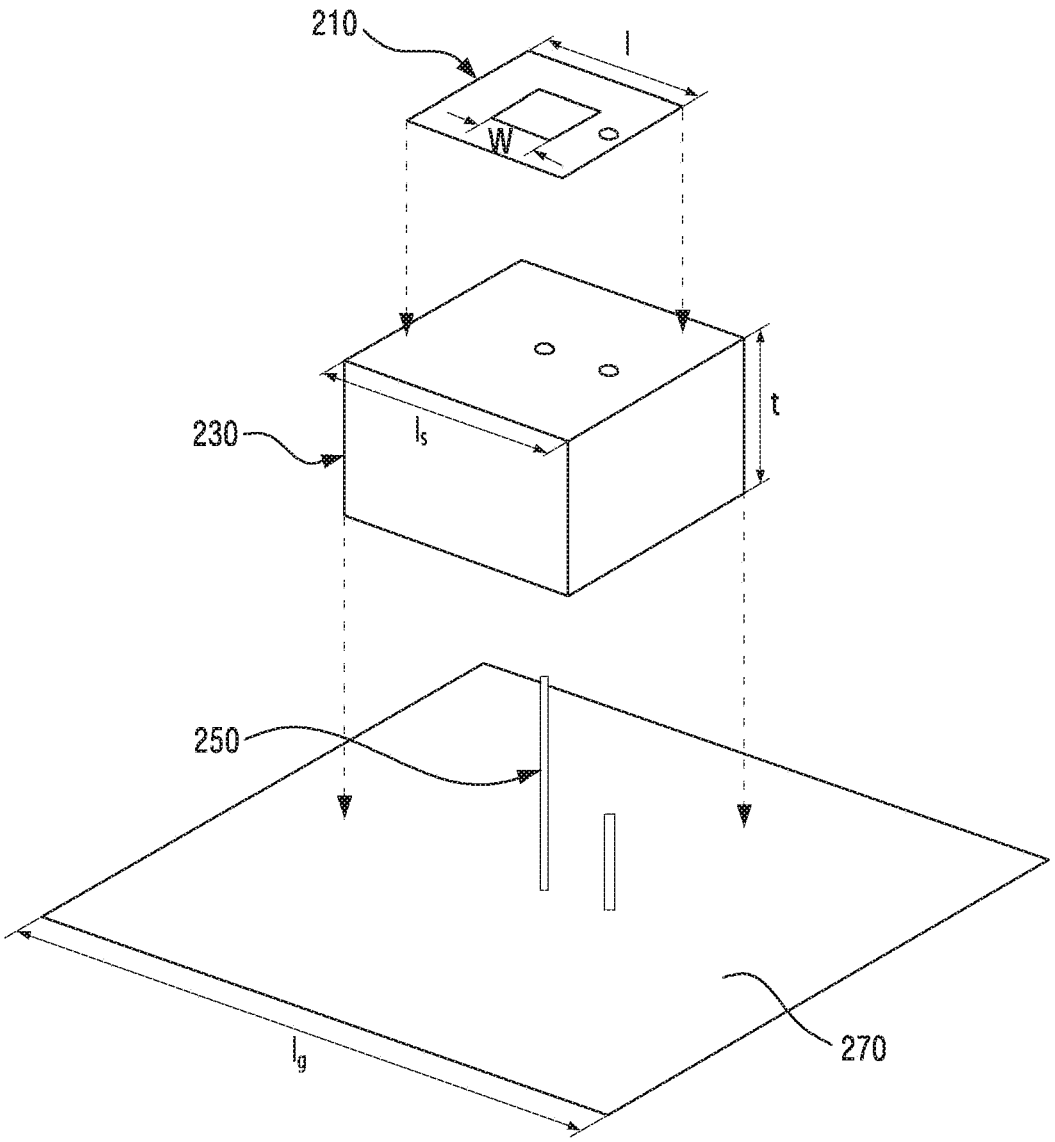
FIG. 2 illustrates a schematic diagram of an array antenna including patch and monopole antennas according to an embodiment of the disclosure.

FIG. 2 illustrates a schematic diagram of an array antenna including patch and monopole antennas according to an embodiment of the disclosure.

Figure 3:
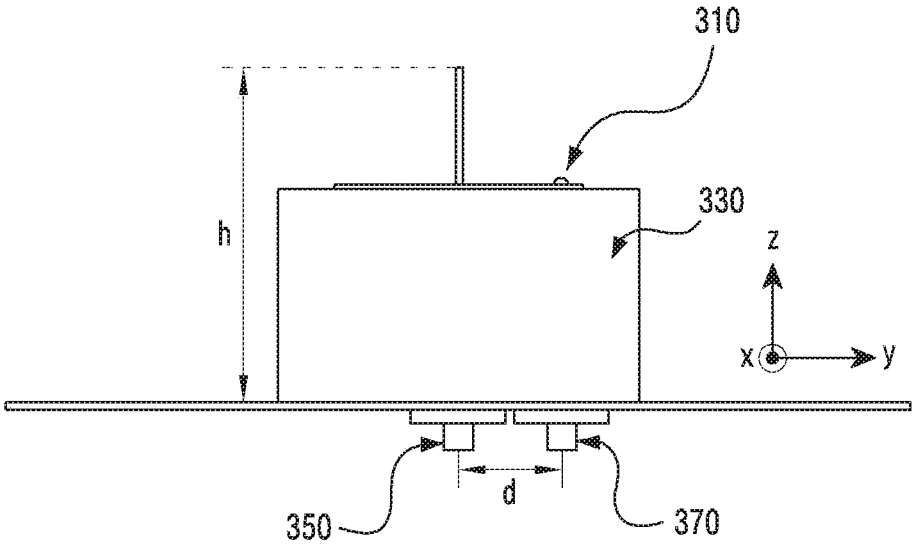
FIG. 3 illustrates a side view of an array antenna including patch and monopole antennas according to an embodiment of the disclosure.

FIG. 3 illustrates a side view of an array antenna including patch and monopole antennas according to an embodiment of the disclosure.

Referring to FIGS. 2 and 3, the patch and monopole antennas share a square ground plate of which a width is $l_g$.

According to various embodiments of the disclosure, a patch antenna 210 which is a first array element may form a square ring shape of which internal and external widths are w and 1. A monopole antenna 250 which is a second array element is disposed at a center of a ground plate with the thickness t and the length h. A substrate 230 may be interposed between the patch antenna 210 and the monopole antennas 350 and 370.

Referring to FIG. 3, the monopole antenna is disposed on a substrate 330. A side surface of a bottom of the monopole antenna may include a feed point 310. The substrate 330 may be included between the monopole antenna and the patch antenna. The distance h from a terminal end of the monopole antenna to the ground is one of geometric parameters of the disclosed array antenna, and coupling of the monopole antenna and the patch antenna of the disclosed antenna may differ according to h. A first feed port of the patch antenna and a second feed port of the monopole antenna have a short distance d. Thanks to the short d in the array antenna of good performance, the coupling of the array antenna may vary depending on the value d, and d may be regarded as one of the geometric parameters of the disclosed array antenna.

According to various embodiments of the disclosure, mutual coupling and impedance matching characteristics between the first and second arrays may be controlled by adjusting the thickness t and the internal width w which are the array antenna geometric parameters.

According to various embodiments of the disclosure, by sharing the ground 270, the antenna ports may be disposed very closely and minimize distortion of the antenna performance.

FIGS. 4A to 4D illustrate orthogonality of an electric field or a magnetic field of each antenna element of an array antenna according to various embodiments of the disclosure. While a first antenna and a second antenna are divided in FIGS. 4A to 4D for ease of explanation, the first antenna and the second antenna may be disposed contiguously as mentioned in FIGS. 1A and 1B. In this case, antennas 411 and 431 may be disposed on the same substrate 330.

Figure 4A:
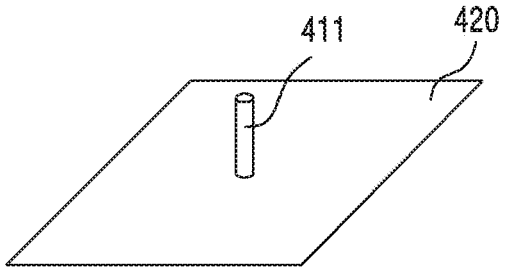
FIG. 4A illustrates a diagram of orthogonality of an electric field or a magnetic field of each antenna element of an array antenna according to an embodiment of the disclosure.
Figure 4B:
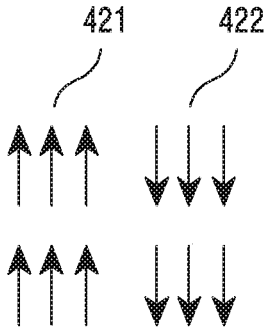
FIG. 4B illustrates a diagram of an orthogonality of an electric field or a magnetic field of each antenna element of an array antenna according to an embodiment of the disclosure.

Referring to FIGS. 4A and 4B, FIG. 4A illustrates the first antenna 411 and the substrate 420 on which the first antenna 411 is disposed, and FIG. 4B illustrates electric fields 421 and 422 generated by the first antenna 411. The first antenna 411 is a monopole antenna disposed vertically on the substrate 410, and the electric fields 421 and 422 are generated by the monopole antenna 411 in directions 421 and 422 perpendicular to the substrate 410, in the same direction as the monopole antenna 411.

According to various embodiments of the disclosure, the electric field generated by the monopole antenna 411 may be generated by changing the direction upwards and downwards with time. The first antenna 411 may generate the electric field by operating in a transverse magnetic (TM) wave propagation mode.

Figure 4C:
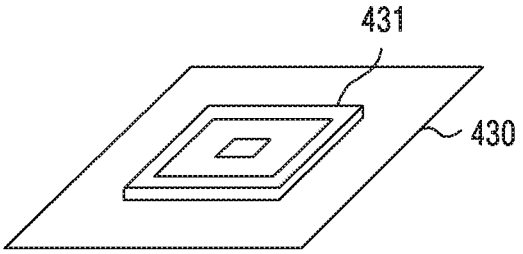
FIG. 4C illustrates a diagram of an orthogonality of an electric field or a magnetic field of each antenna element of an array antenna according to an embodiment of the disclosure.
Figure 4D:
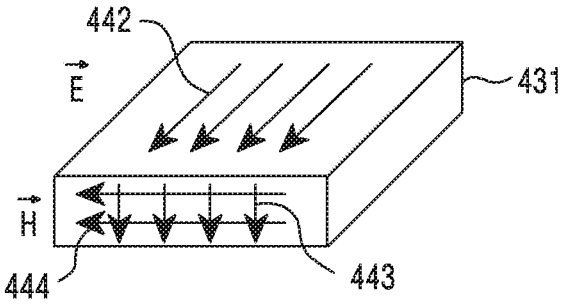
FIG. 4D illustrates a diagram of an orthogonality of an electric field or a magnetic field of each antenna element of a array antenna according to an embodiment of the disclosure.

Referring to FIGS. 4C and 4D, FIG. 4C illustrates the second antenna 431 and the substrate 430 on which the second antenna 431 is disposed, and FIG. 4D illustrates electric fields 442 and 443 and a magnetic field 444 generated by the second antenna 431. The second antenna 431 is a patch antenna of a loop shape flush with the substrate 430, and the electric field generated by the second antenna 431 of the loop shape is concentrated in a particular direction flush with the substrate 431. The second antenna 431 may generate the electric field by operating in a transverse electric (TE) wave propagation mode.

If the patch antenna 431 is disposed on a dielectric, the electric field may be generated by the patch antenna 431 of the loop shape in a downward direction 443 in view of the dielectric. In this case, the magnetic field may be generated by the patch antenna 431 in parallel with the patch antenna 431 in view of the dielectric.

Comparing the magnetic fields in FIG. 4B and FIG. 4D, the electric fields 421 and 422 are generated by the first antenna 411 in the transverse direction to a plane including the substrate 420 and 430, and the electric field 442 is generated by the second antenna 431 in the same direction as the substrate 420 and 430. Hence, the electric fields 421 and 422 generated by the first antenna 411 and the electric field 442 generated by the second antenna 431 are orthogonal, and their influences are minimized.

According to various embodiments of the disclosure, the magnetic field generated by the first antenna 411 and the magnetic field generated by the second antenna 431 may be orthogonal.

According to various embodiments of the disclosure, a correlation between the electric field generated by the first antenna 411 and the electric field generated by the second antenna 431 may fall below a first threshold which is predetermined. Alternatively, a correlation between the magnetic field generated by the first antenna 411 and the magnetic field generated by the second antenna 431 may fall below a second threshold which is predetermined.

Figure 5:
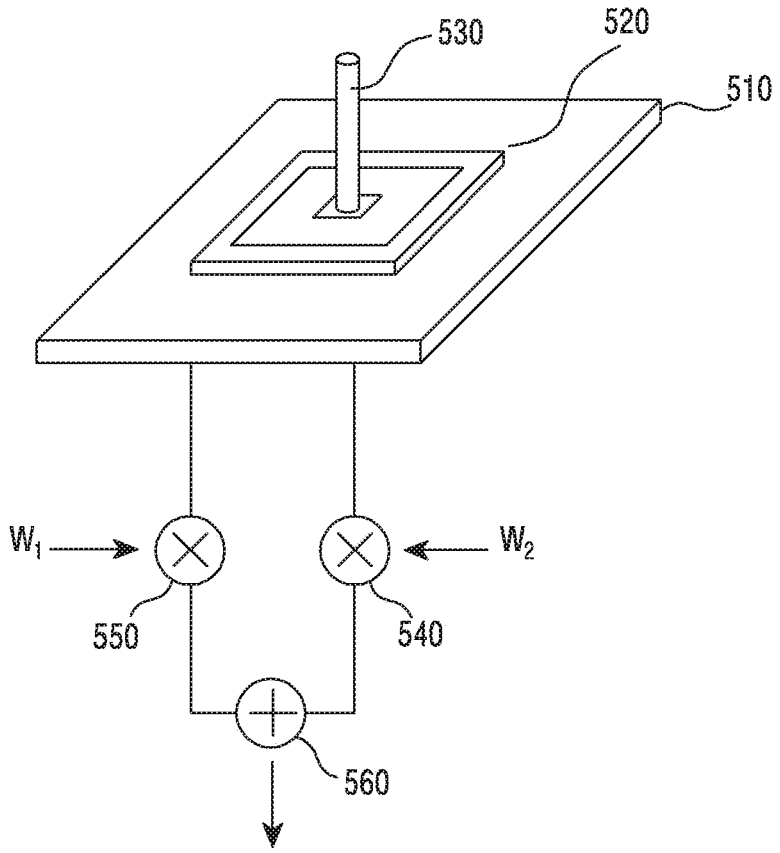
FIG. 5 illustrates a structure for controlling a beam pattern of an array antenna, or canceling an interference signal according to an embodiment of the disclosure.

FIG. 5 illustrates a structure for controlling a beam pattern of an array antenna, or canceling an interference signal according to an embodiment of the disclosure.

Referring to FIG. 5, the array antenna includes a monopole antenna used as a first antenna 530 and a patch antenna of a loop shape used as a second antenna 520, on a substrate 510. Signals received using the first antenna 530 and the second antenna 520 are inputted to multipliers 540 and 550 respectively. The multiplier 540 and 550 multiplies the received signal by a weight. An array antenna receiver 560 generates a received signal of the array antenna by adding the signals multiplied by the weights.

According to various embodiments of the disclosure, by adequately determining the weight values multiplied by the signals respectively, a great gain may be given in a particular direction, and a signal incoming in a corresponding direction may be cancelled by forming the null.

According to various embodiments of the disclosure, a weight for determining the beam pattern of the array antenna may be updated through iterative calculation based on Equation 1.

$$\overline{w}_{k+1}=\overline{w}_k-2\cdot\mu\cdot(\overline{r}_{xd})_k+2\cdot\mu\cdot(\overline{R}_{xx})\cdot\overline{w}_k \qquad \text{Equation 1}$$

$\overline{w}_{k+1}$ is a weight vector of a (k+1)-th iterative calculation, and $\overline{w}_k$ is a weight vector of a k-th iterative calculation. The weight vector includes, as an element, the weight multiplied by the signal received using each antenna 520 and 530. $\mu$ is an adaptive gain value, and is a constant greater than 0 and smaller than 1 $(\overline{r}_{xd})_k$ is a cross correlation matrix of a received signal vector $\overline{x}_k$ and a reference signal $d_k$ in the k-th iterative calculation, and $(\overline{R}_{xx})_k$ is a covariance matrix of the received signal vector $\overline{x}_k$ in the k-th iterative calculation.

Figure 6:
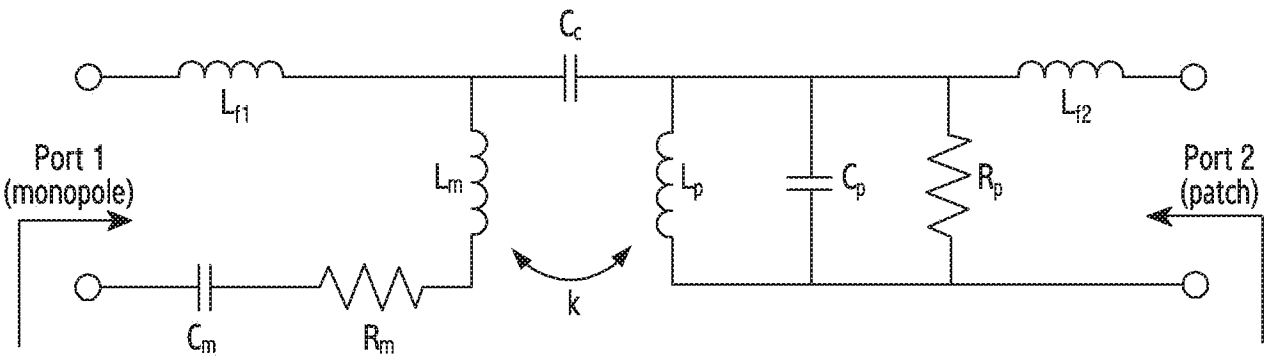
FIG. 6 illustrates an equivalent circuit using a 2-port network of an array antenna of FIGS. 1A and 1B according to an embodiment of the disclosure.

FIG. 6 illustrates an equivalent circuit using a 2-port network of an array antenna of FIGS. 1A and 1B according to an embodiment of the disclosure.

Referring to FIG. 6, an impedance 50 ohm (Ω) is supplied through a fin directly connected to each array element and modeled with inductance $L_{f1}$ and $L_{f2}$.

The monopole antenna is modeled in series of resistance $R_m$, inductance $L_m$, and capacitance $C_m$, and the patch antenna is modeled in parallel of resistance $R_p$, inductance $L_p$, and capacitance $C_p$. Hence, the monopole and patch antennas of the array antenna are coupled by coupling capacitance $C_c$ and an inductive coupling coefficient k. The coupling capacitance $C_c$ and the inductive coupling coefficient k may be changed by the geometric parameter h or w of the array antenna. Herein, h indicates the height h of the monopole antenna which is the first antenna, and w indicates the internal width w of the patch antenna which is the second antenna.

Figure 7:
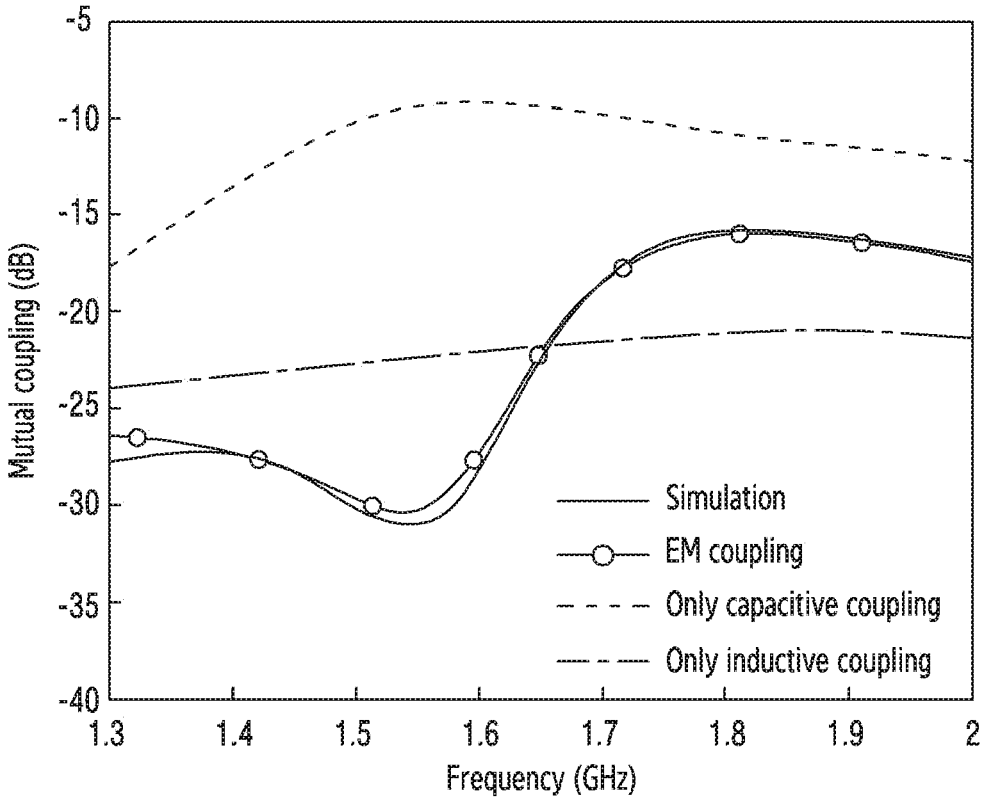
FIG. 7 illustrates mutual coupling effect of electric and magnetic coupling of an array antenna according to an embodiment of the disclosure.

FIG. 7 illustrates mutual coupling effect of electric and magnetic coupling of an array antenna according to an embodiment of the disclosure.

Referring to FIG. 7, a solid line shows mutual coupling simulation results of the array antenna of the disclosure, and a dashed line shows values calculated from the equivalent circuit of FIG. 6. The mutual coupling after removing the inductive coupling coefficient k or the coupling capacitance $C_c$ are marked with a dotted line or a dash-dotted line.

To more precisely observe the electromagnetic coupling effect of FIG. 7, a target frequency is set to 1.6 GHz according to the changes of $C_c$ and k of the circuit model, which is expressed as Equation 2.

$$S_{12}(C_c, k) = \frac{(-1.5 + j3.8) \cdot 10^{11} C_c + (-1.2 + j2.4)k + C_c \cdot k^2 (2.0 - j3.9) \cdot 10^{11}}{\left( \begin{array}{c} (-3.7 + j3.2) \cdot 10^{12} C_c + (-7.6 + j4) \cdot \\ 10^{11} C_c \cdot k + (2.5 + j5.9) \cdot 10^2 C_c \cdot k^2 + \\ (-0.1 - j4.4)k^2 + 8.6 - j4.2 \end{array} \right)} \quad \text{Equation 2}$$

Figure 8:
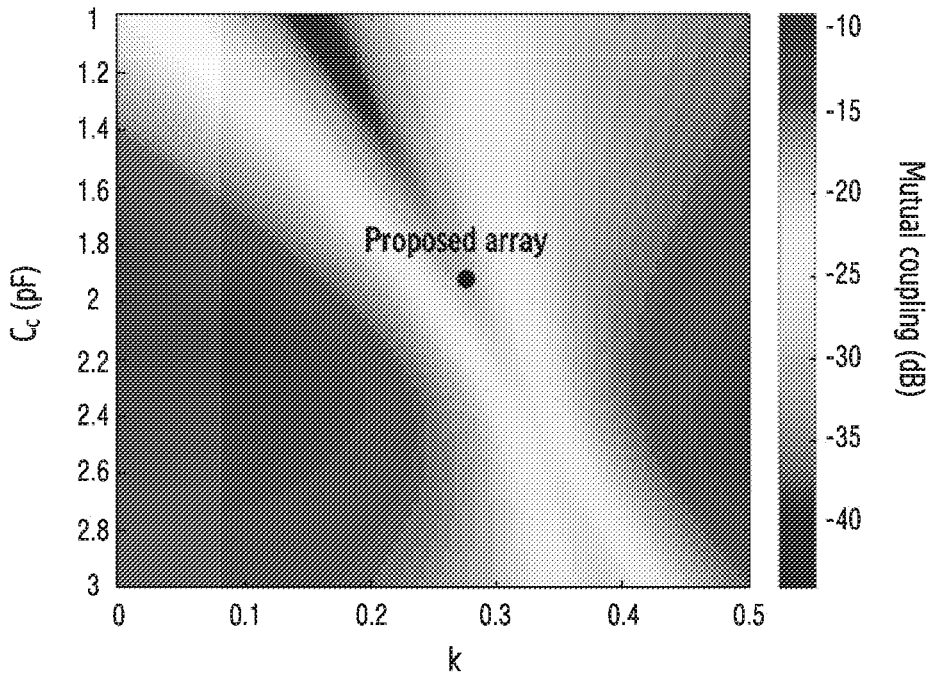
FIG. 8 illustrates a graph of Equation 1 according to an embodiment of the disclosure.

FIG. 8 illustrates a graph of Equation 2 according to an embodiment of the disclosure.

Referring to FIG. 8, mutual coupling S is shown based on the changes of $C_c$ and k based on the target frequency 1.6 GHz. Values of the array antenna of the disclosure are indicated by dots in response to the target frequency 1.6 GHz, the value $C_c$ corresponding to a coupling frequency of about −25 dB corresponds to about 2 pF, and k corresponds to about 0.28.

Figure 9A:
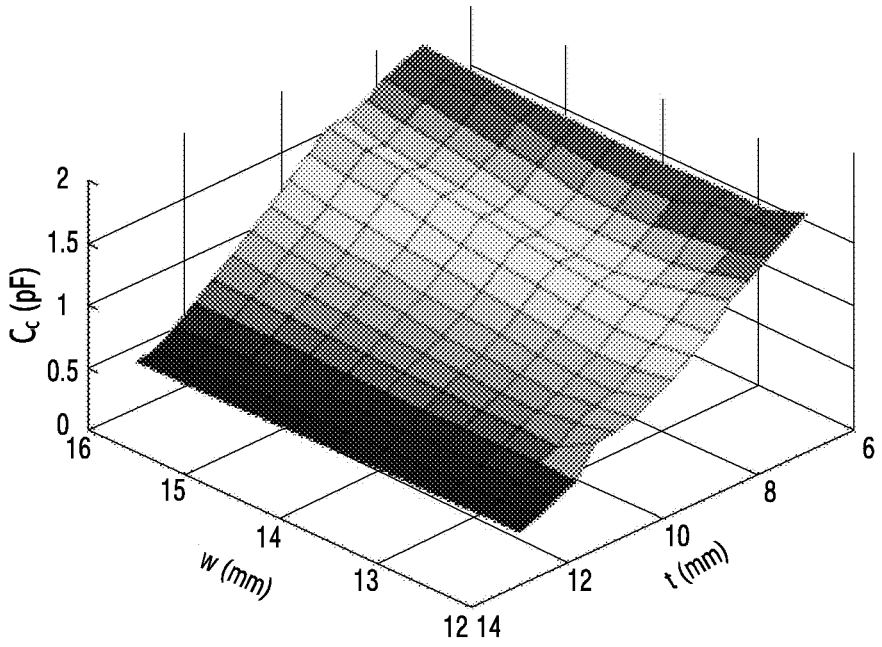
FIG. 9A illustrates relations between geometric parameters w and t and $C_c$ of an array antenna according to an embodiment of the disclosure.

FIG. 9A illustrates relations between geometric parameters w and t and $C_c$ of an array antenna according to an embodiment of the disclosure.

Figure 9B:
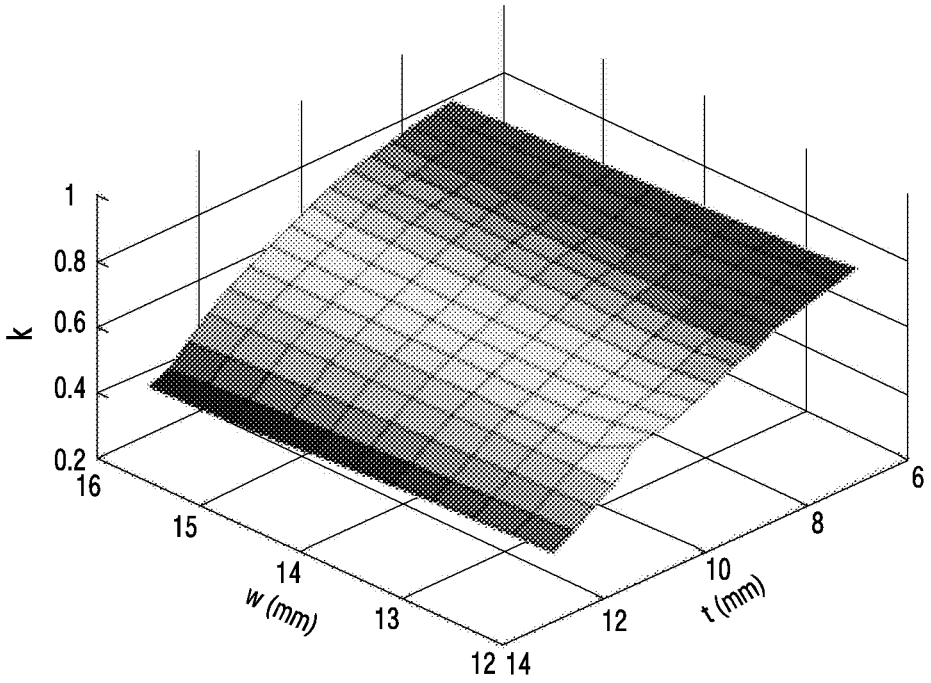
FIG. 9B illustrates relations between a geometric parameters w and t and k of an array antenna according to an embodiment of the disclosure.

FIG. 9B illustrates relations between the geometric parameters w and t and k of the array antenna according to an embodiment of the disclosure.

Referring to FIGS. 9A and 9B, the coupling capacitance $C_c$ and the inductive coupling coefficient k may be determined by adjusting the geometric parameters w and t of the array antenna of the disclosure. For example, if the target frequency is set to 1.6 GHz, $C_c$ may be adjusted to 0.4~2 pF and k may be adjusted to 0.35~0.85, which are appropriate values.

Thus, the array antenna of the disclosure may achieve both of the low mutual coupling and the good impedance matching characteristics by adjusting the geometric parameters. For example, each array antenna having the transverse current direction may provide an orthogonal radiation pattern of a low pattern correlation due to clear modal difference between the array antennas.

Figure 10A:
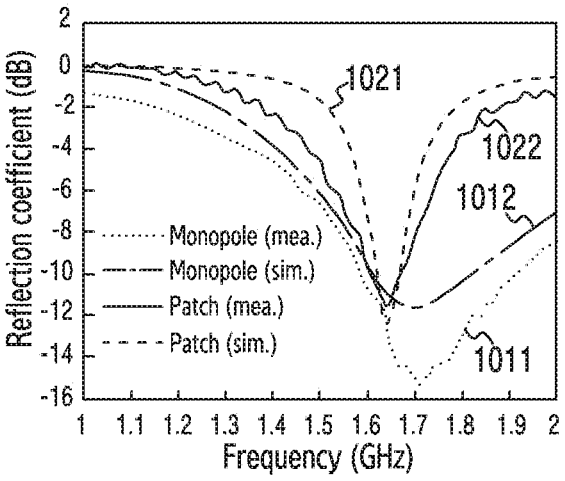
FIG. 10A illustrates a diagram of a reflection coefficient and a frequency response of an array antenna according to an embodiment of the disclosure.
Figure 10B:
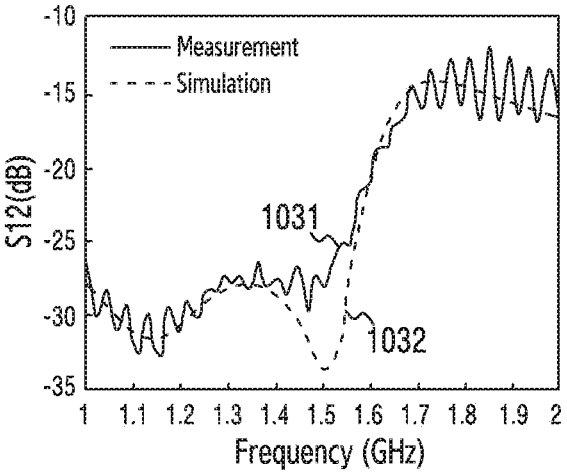
FIG. 10B illustrates a diagram of a reflection coefficient and a frequency response of an array antenna according to an embodiment of the disclosure.

FIGS. 10A and 10B illustrate diagrams of a reflection coefficient and a frequency response of an array antenna according to various embodiments of the disclosure.

Referring to FIG. 10A, it illustrates reflection coefficients of the first antenna and the second antenna. In FIG. 10A, the horizontal axis indicates a frequency band, and the vertical axis indicates a magnitude of the reflection coefficient based on dB scales. In FIG. 10A, actual measurement values 1011 of the reflection coefficient of the first antenna are similar in form to values 1012 calculated by simulating the reflection coefficient of the first antenna. Actual measurement values 1021 of the reflection coefficient of the second antenna are similar in form to values 1022 calculated by simulating the reflection coefficient of the second antenna.

Referring to FIG. 10B, it illustrates a scattering coefficient between the first antenna and the second antenna, wherein the horizontal axis indicates the frequency band and the vertical axis indicates a magnitude of the scattering coefficient based on the dB scales. In the graph of FIG. 10B, actual measurement values 1031 of the scattering coefficient are quite similar in form to values 1032 calculated through simulation. Accordingly, the mutual coupling between the first antenna and the second antenna is maintained at a very low level.

In the graphs of FIG. 10A and FIG. 10B, the array antenna according to various embodiments of the disclosure independently operates the antenna elements (the first antenna and the second antenna) of the array antenna, by minimizing mutual influence.

Figure 11A:
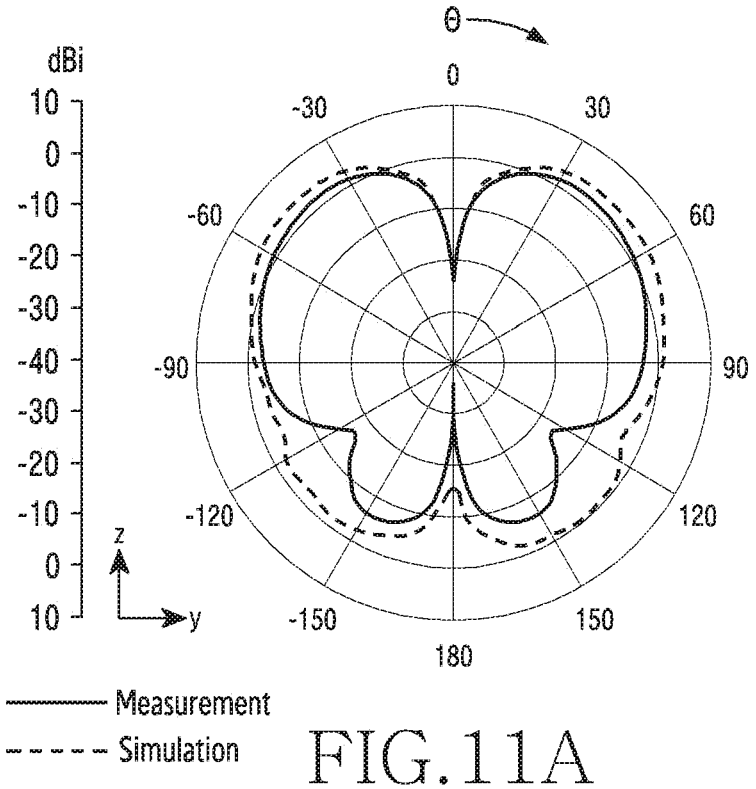
FIG. 11A illustrates a beam pattern of antenna elements of an array antenna according to an embodiment of the disclosure.
Figure 11B:
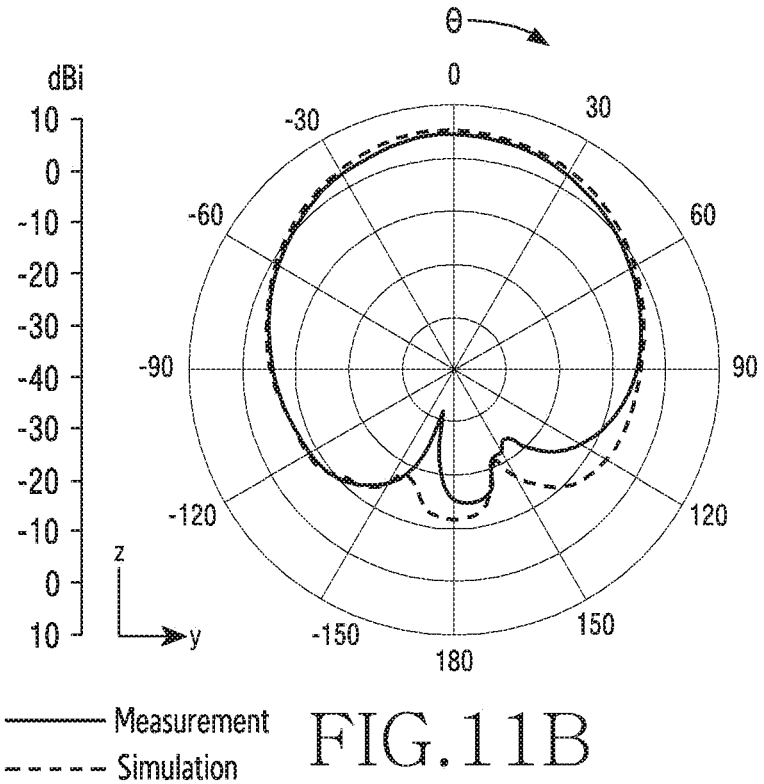
FIG. 11B illustrates a beam pattern of antenna elements of an array antenna according to an embodiment of the disclosure.

FIGS. 11A and 11B illustrate a beam pattern of antenna elements of an array antenna according to various embodiments of the disclosure.

FIG. 11A illustrates the beam pattern of the monopole antenna used as the first antenna, and FIG. 11B illustrates the beam pattern of the patch antenna of the loop shape used as the second antenna. The solid line and the dotted line show measurement and simulation results respectively.

Referring to FIGS. 11A and 11B, the first antenna and the second antenna are very similar in both of the simulation result and the measurement value.

Figure 12:
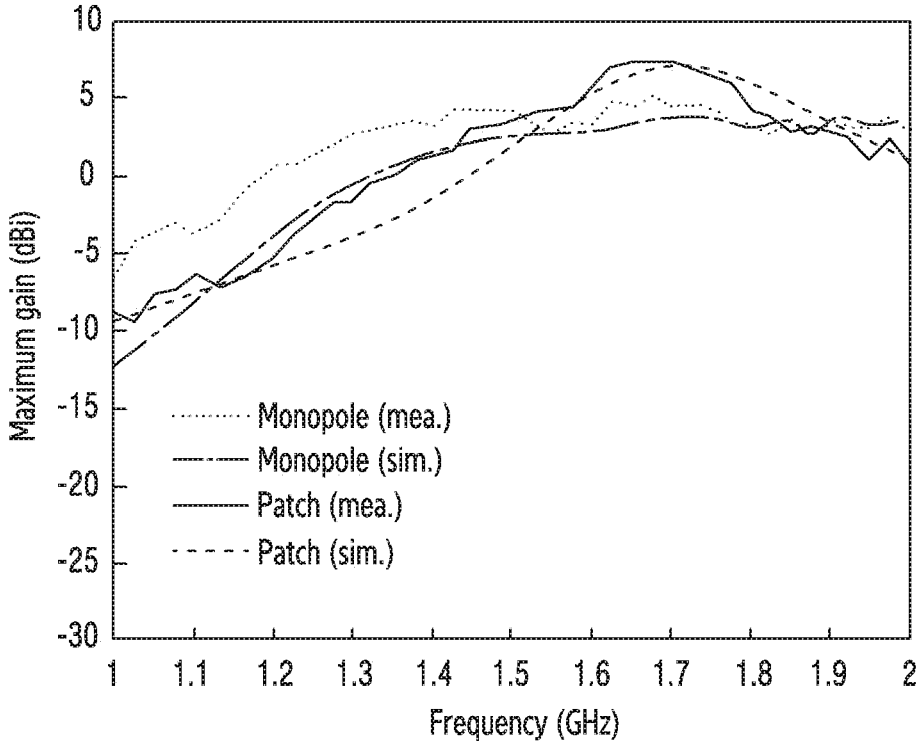
FIG. 12 illustrates a maximum gain obtained in an upper hemisphere of an array antenna according to an embodiment of the disclosure.

FIG. 12 illustrates a maximum gain obtained in an upper hemisphere of an array antenna according to an embodiment of the disclosure.

Referring to FIG. 12, the maximum gain of the monopole antenna and the patch antenna is 3.8 dBi and 6.1 dBi respectively.

Figure 13A:
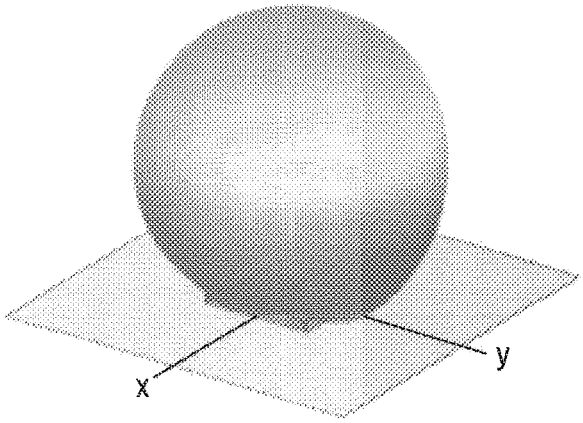
FIG. 13A illustrates a beam pattern adaptively changed in an array antenna according to an embodiment of the disclosure.
Figure 13B:
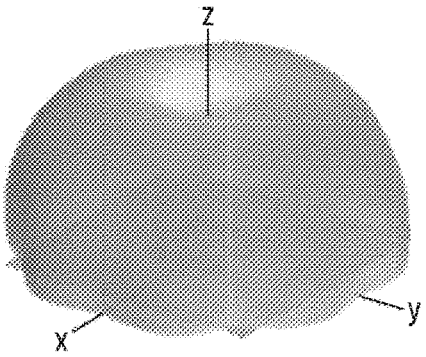
FIG. 13B illustrates a beam pattern adaptively changed in array antenna according to an embodiment of the disclosure.

FIGS. 13A and 13B illustrate beam patterns adaptively changed in an array antenna according to various embodiments of the disclosure.

Referring to FIG. 13A, it illustrates an initial beam pattern before changed in the array antenna. The initial beam pattern is formed almost in circle.

Referring to FIG. 13B, it illustrates the beam pattern after being changed in the array antenna. By forming the null in an upward direction from which an interference signal comes in, the changed beam pattern may minimize reception of the interference signal by giving a small gain close to zero in the corresponding direction and giving a considerable gain in other directions.

Figure 14A:
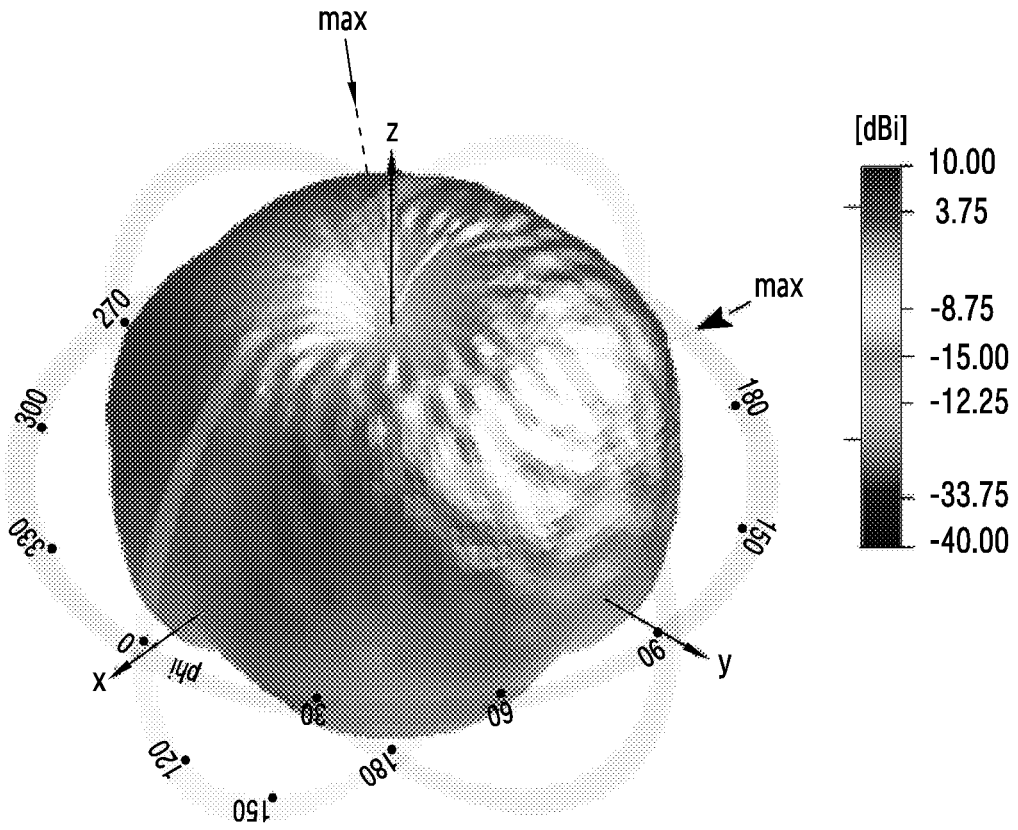
FIG. 14A illustrates a 3D active element pattern of monopole and patch elements at a target frequency 1.6 GHz according to an embodiment of the disclosure.
Figure 14B:
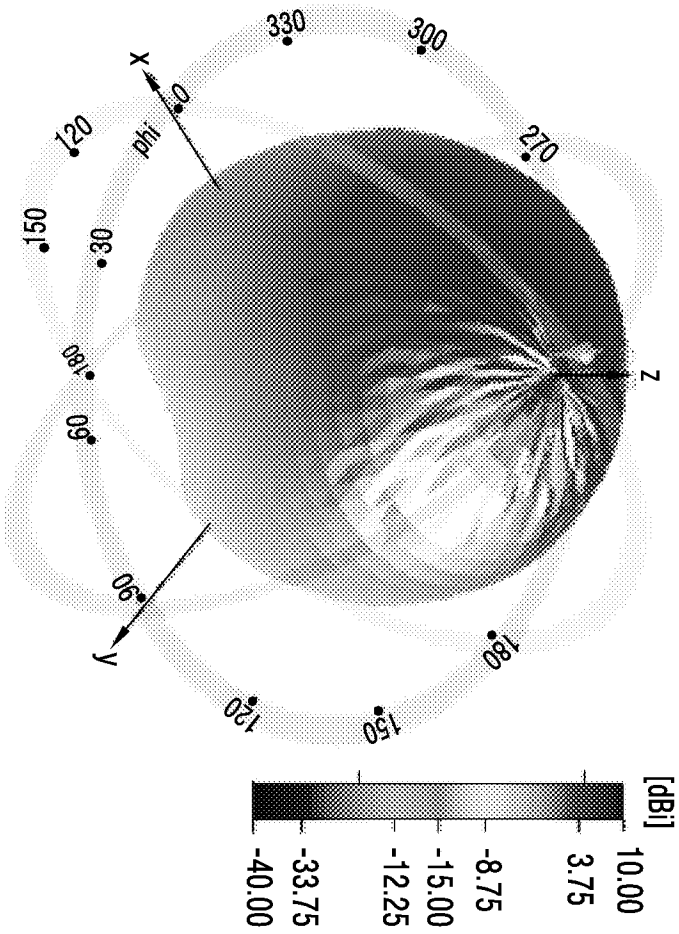
FIG. 14B illustrates a 3D active element pattern of a monopole and patch elements at a target frequency 1.6 GHz according to an embodiment of the disclosure.

FIGS. 14A and 14B illustrate 3D active element patterns of monopole and patch elements at a target frequency 1.6 GHz according to various embodiments of the disclosure.

Referring to FIGS. 14A and 14B, although the first antenna and the second antenna is very close to each other, the pattern shape of the active element individually is very similar to the radiation pattern of the monopole antenna and the patch antenna.

The patch antenna exhibits a half power beam width at 76.1 degrees and 85.2 degrees in the z-x plane and the z-y plane respectively. The patch antenna obtains the maximum radiation gain at 5 degrees and the patch antenna obtains the maximum radiation gain at 45 degrees.

For example, the 2-element array antenna according to various embodiments of the disclosure may maintain the independent radiation pattern with the high isolation and the low correlation between the array elements even at a narrow array spacing.

Figure 15:
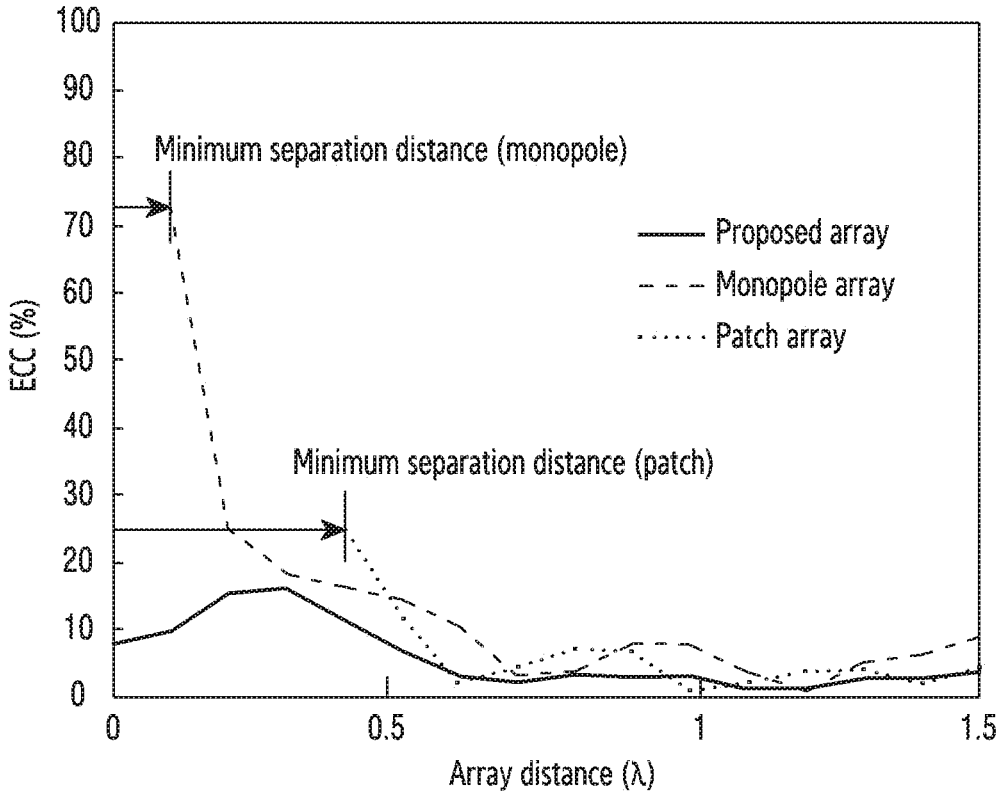
FIG. 15 illustrates an envelope correlation coefficient of an array antenna based on a distance according to an embodiment of the disclosure.

FIG. 15 illustrates an envelope correlation coefficient of an array antenna based on a distance according to an embodiment of the disclosure.

Referring to FIG. 15, the horizontal axis indicates a distance between antenna elements, and the vertical axis relatively indicates a magnitude of the envelope correlation coefficient.

Referring to FIGS. 1A and 1B, if the array antenna is disposed as shown in FIGS. 1A and 1B, the envelope correlation coefficient between the electric fields generated by the antenna elements may be calculated based on Equation 3.

$$\rho_{ECC} = \frac{\iint_{4\pi} E_1(\theta, \phi) \cdot E_2^*(\theta, \phi) d\Omega}{\sqrt{\iint_{4\pi} E_1(\theta, \phi) \cdot E_1^*(\theta, \phi) d\Omega \iint_{4\pi} E_2(\theta, \phi) \cdot E_2^*(\theta, \phi) d\Omega}} \quad \text{Equation 3}$$

$\rho_{ECC}$ denotes the envelope correlation coefficient between far-field radiation patterns, and $E_1(\theta, \phi)$ denotes the far-field radiation pattern generated by the first antenna. $E_2(\theta, \phi)$ denotes the far-field radiation pattern generated by the second antenna, $E^*_1(\theta, \phi)$ denotes a conjugate complex number of $E_1(\theta, \phi)$, and $E^*_2(\theta, \phi)$ denotes a conjugate complex number of $E_2(\theta, \phi)$. $\theta$ denotes an azimuth, and $\phi$ denotes an elevation.

Equation 3 may be re-expressed as Equation 4.

$$\rho_{ECC} = -\frac{S_{11}S_{12}^* + S_{21}S_{22}^*}{\sqrt{(1 - |S_{11}|^2 - |S_{21}|^2)(1 - |S_{22}|^2 - |S_{12}|^2)\eta_1\eta_2}} \quad \text{Equation 4}$$

$S_{ij}$ denotes an S parameter of a j-th antenna for an i-th antenna, $\eta_1$ denotes a radiation efficiency of the first antenna, and $\eta_2$ denotes a radiation efficiency of the second antenna. Equation 4 expresses Equation 3 by using the scattering S parameter between the antennas. The S parameter is changed in value according to the distance between the antennas.

Hence, Equation 4 is the function based on the distance between the antennas, which may be represented as shown in FIG. 15.

Referring to FIG. 15, the blue graph shows the envelope correlation coefficient of the array antenna according to various embodiments of the disclosure, and the line of proposed array shows an envelope correlation coefficient of an array antenna including two monopole antennas. The line of patch array shows an envelope correlation coefficient of an array antenna including two patch antennas.

Referring to FIG. 15, the envelope correlation coefficient of the array antenna including the two monopole antennas is not defined below a particular value due to the physical shape of the monopole antenna. The envelope correlation coefficient of the array antenna including the two monopole antennas approximately reduces as the distance between the antennas increases.

The envelope correlation coefficient of the array antenna including the two patch antennas is not defined below a particular value due to the physical shape of the patch antenna. The envelope correlation coefficient of the array antenna including the two patch antennas approximately reduces as the distance between the antennas increases.

The envelope correlation coefficient of the array antenna including the monopole antenna and the patch antennas according to various embodiments of the disclosure may be defined even for a very small value by placing the two antennas very closely as shown in FIGS. 1A and 1B. If the two antennas are very close, the envelope correlation coefficient of the antennas has the magnitude of about 10% of the maximum value and thus the envelope correlation coefficient may maintain the quite small value.

Referring to FIG. 15, in the array antenna according to various embodiments of the disclosure, the electric fields generated by the antenna elements are perpendicular to each other not to affect each other, and the envelope correlation coefficient is maintained as the small value.

The 2-element array antenna according to various embodiments of the disclosure may maintain the independent radiation pattern with the high isolation and the low correlation between the array elements even at the narrow array spacing.

Figure 16A:
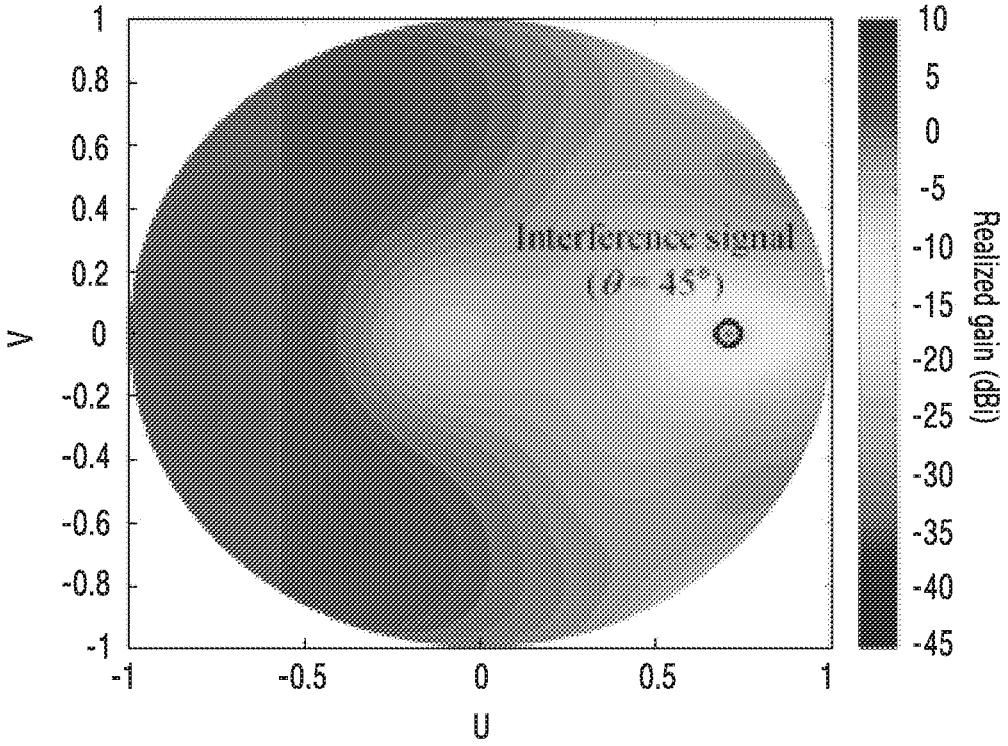
FIG. 16A illustrates an optimized null pattern of an array antenna in a u-v domain according to an embodiment of the disclosure.
Figure 16B:
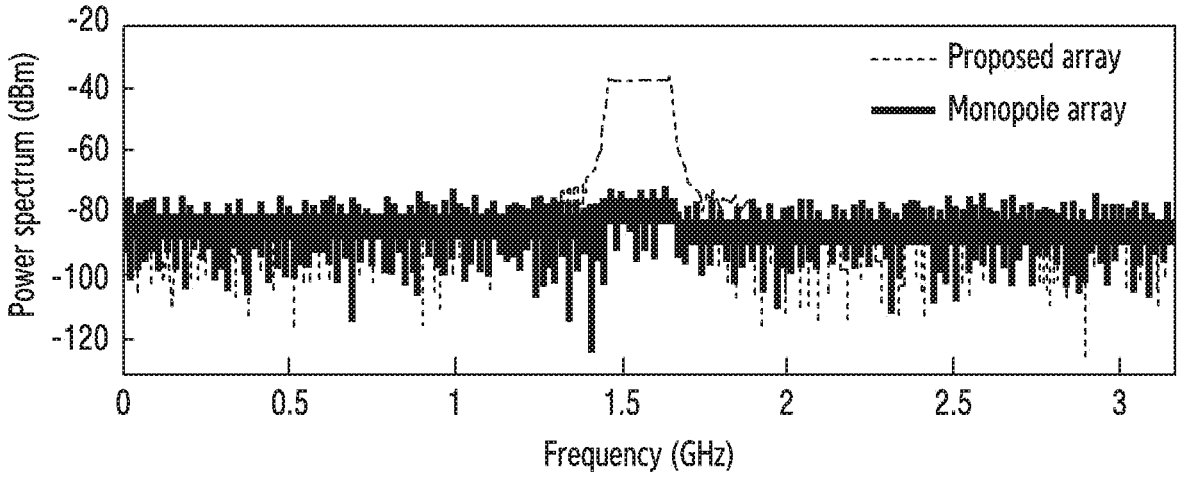
FIG. 16B illustrates initial and final power spectrums of an array antenna according to an embodiment of the disclosure.
Figure 16C:
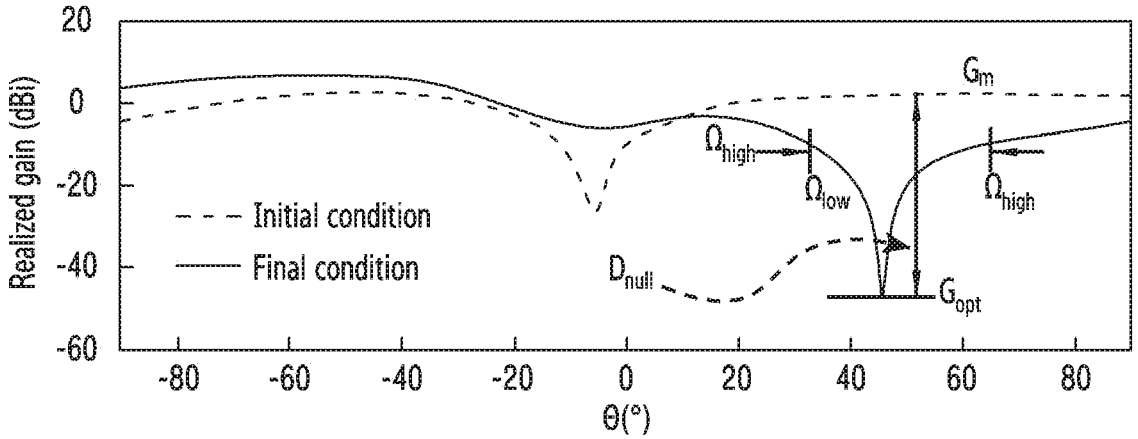
FIG. 16C illustrates a gain value of an optimized null pattern of an array antenna according to an embodiment of the disclosure.

FIG. 16A illustrates an optimized null pattern of an array antenna in a u-v domain according to an embodiment of the disclosure. FIG. 16B illustrates initial and final power spectrums of the array antenna according to an embodiment of the disclosure. FIG. 16C illustrates a gain value of the optimized null pattern of the array antenna according to an embodiment of the disclosure.

Referring to FIGS. 16A, 16B, and 16C, even with the short distance between the monopole antenna and the patch antenna of the disclosed array antenna, interference may be minimized. Referring to the simulation results of FIGS. 16A, 16B, and 16C, if a direction of an interference angle changes from −60 degrees to 60 degrees in a first interval and independent gaussian random noise is generated through 50 repetitions, a jammer power to noise power ratio (JNR) is changed from 10 dB to 40 dB.

Referring to FIG. 16B, by applying the optimal null weight to the disclosed array antenna, chirp interference signal may be suppressed effectively.

Referring to FIG. 16C, $D_{null}$ is determined by a difference of the initial array gain $G_{in}$ and the final array gain $G_{opt}$. Hence, $D_{null}$ is the parameter indicating how deep the null is formed in the interference direction in the beam pattern.

Referring to FIG. 16C, the optimal null pattern of the disclosed array antenna has the null width of 33.2 degrees and $D_{null}$ of 47.7 dB.

Figure 17:
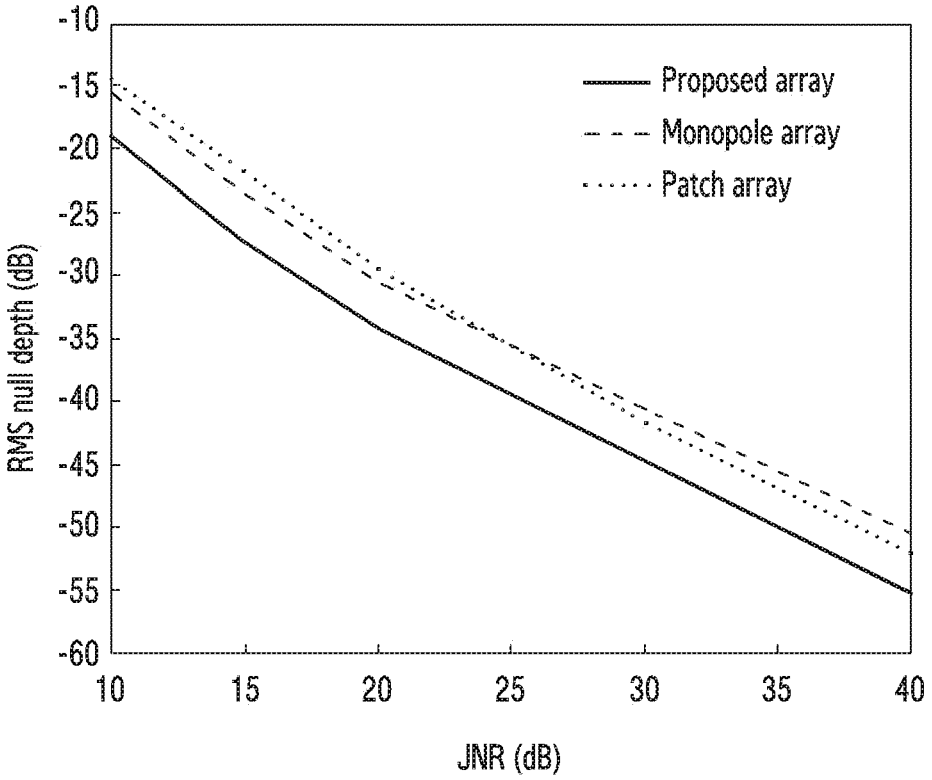
FIG. 17 illustrates comparison of a root-mean-square (RMS) null depth of a jammer power to noise power ratio (JNR) between an array antenna of the disclosure and monopole and patch antennas of the relater art according to an embodiment of the disclosure.

FIG. 17 illustrates comparison of a root-mean-square (RMS) null depth of a JNR between an array antenna and monopole and patch antennas of the relater art according to an embodiment of the disclosure.

The disclosed array antenna has the greatest null depth, compared with the monopole and patch array antennas of the relater art.

Referring to FIG. 17, the RMS null depth is obtained at the JNR of 40 dB.

Figure 18:
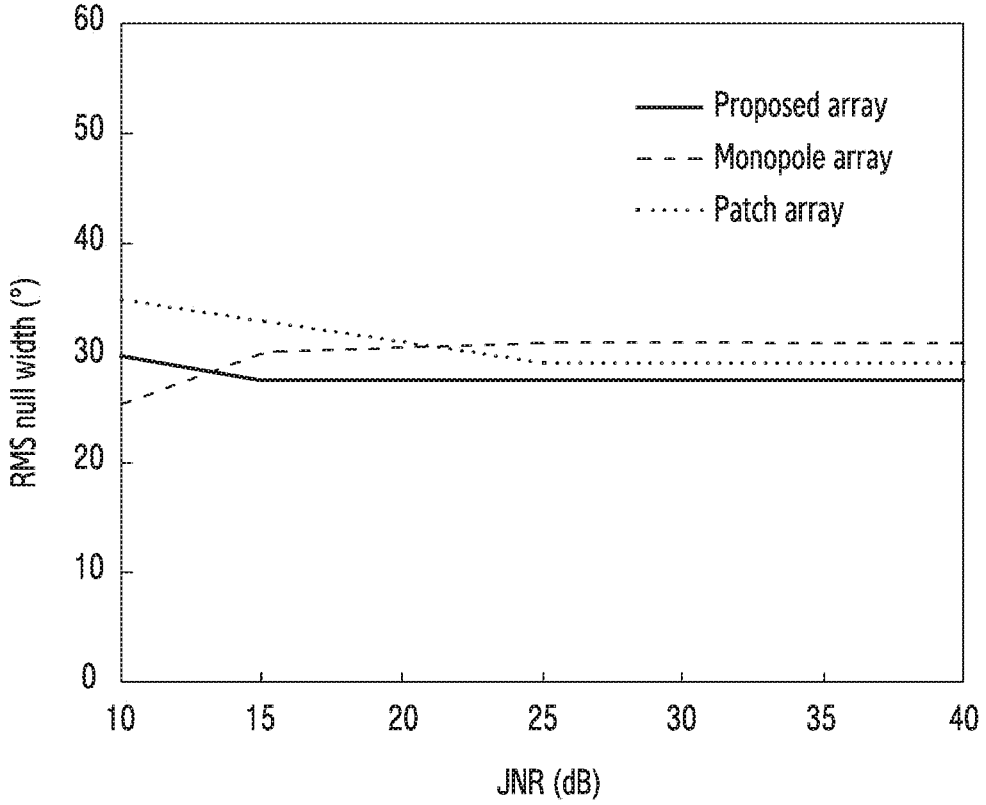
FIG. 18 illustrates a graph of a JNR to an RMS null width according to an embodiment of the disclosure.

FIG. 18 illustrates a graph of a JMR to an RMS null width according to an embodiment of the disclosure.

Referring to FIG. 18, if the JNR increases over 15 dB, the RMS null width becomes 27.6 which is the smallest width.

Figure 19:
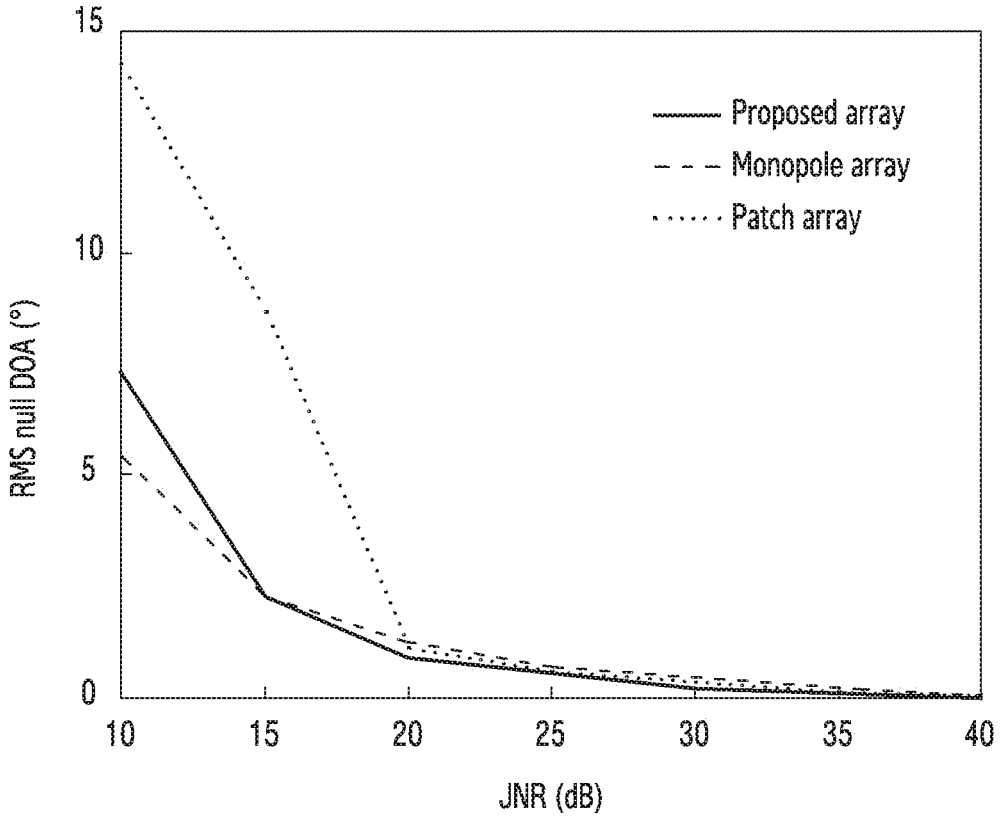
FIG. 19 illustrates an RMS null direction of angle (DOA) error of an array antenna according to an embodiment of the disclosure.

FIG. 19 illustrates an RMS null direction of angle (DOA) error of an array antenna according to an embodiment of the disclosure.

Referring to FIG. 19, below the JNR 20 dB, the RMS null DOA error is higher than the patch or monopole antenna of the relater art, and the lowest RMS DOA error is 0.8 degrees.

Thus, since the two-element array has the very short array distance due to the modal difference, the disclosed array antenna may exhibit high null pattern characteristics and achieve low pattern correlation and high isolation.

Figure 20A:
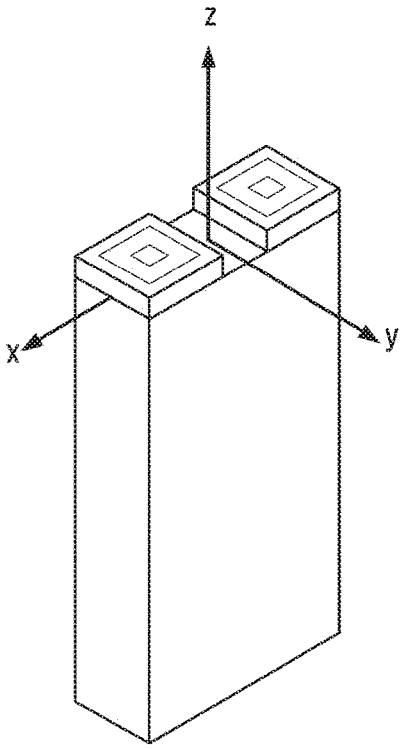
FIG. 20A illustrates a 2-element array antenna in two rows according to an embodiment of the disclosure.

FIG. 20A illustrates a 2-element array antenna in two rows according to an embodiment of the disclosure.

Figure 20B:
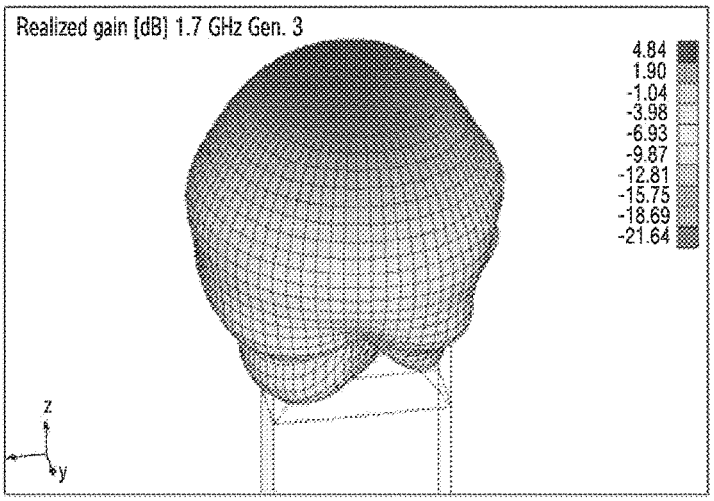
FIG. 20B illustrates a 2-element array antenna in two rows according to an embodiment of the disclosure.

FIG. 20B illustrates the 2-element array antenna in the two rows according to an embodiment of the disclosure.

Figure 20C:
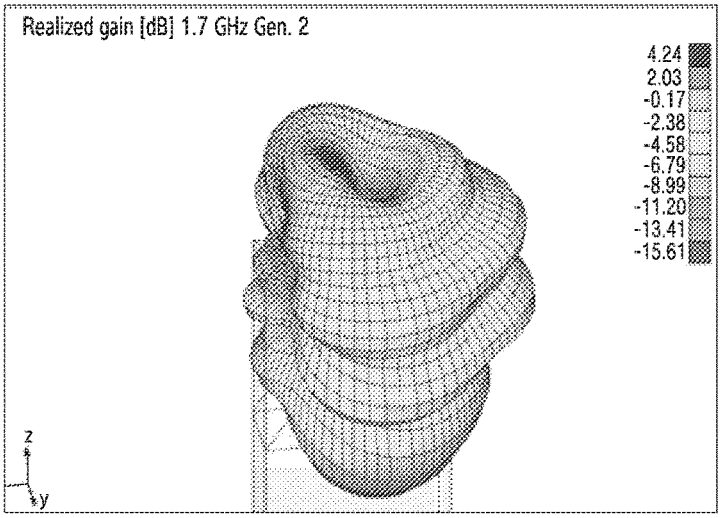
FIG. 20C illustrates a 2-element array antenna in two rows according to an embodiment of the disclosure.

FIG. 20C illustrates the 2-element array antenna in the two rows according to an embodiment of the disclosure.

Referring to FIGS. 20A, 20B, and 20C, even if the 2-element array antenna is disposed in the two rows, a peak radiation gain of the patch antenna occurs near bore sight. Also, in the monopole antenna, the null occurs near the front direction. Hence, in the 2-element array antenna disposed in the two rows, the performance is maintained similarly to the radiation pattern of the single antenna.

Figure 21A:
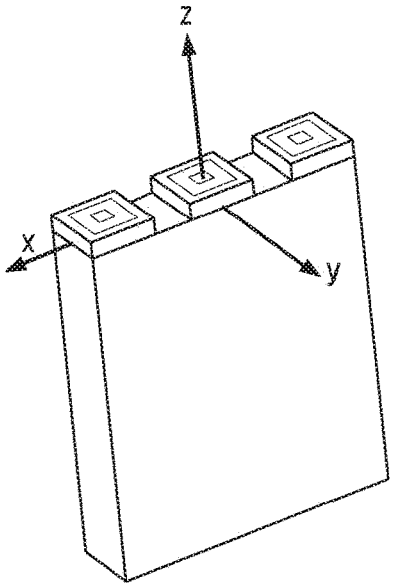
FIG. 21A illustrates a 2-element array antenna in three rows according to an embodiment of the disclosure.

FIG. 21A illustrates a 2-element array antenna in three rows according to an embodiment of the disclosure.

Figure 21B:
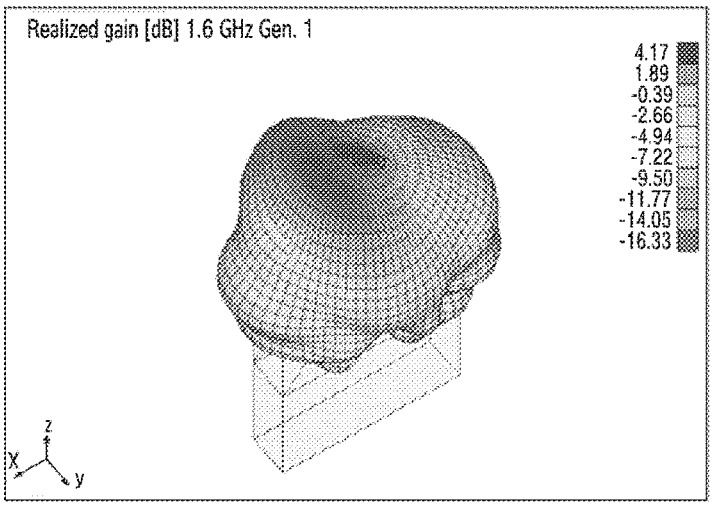
FIG. 21B illustrates 2-element array antenna in three rows according to an embodiment of the disclosure.

FIG. 21B illustrates the 2-element array antenna in the three rows according to an embodiment of the disclosure.

Figure 21C:
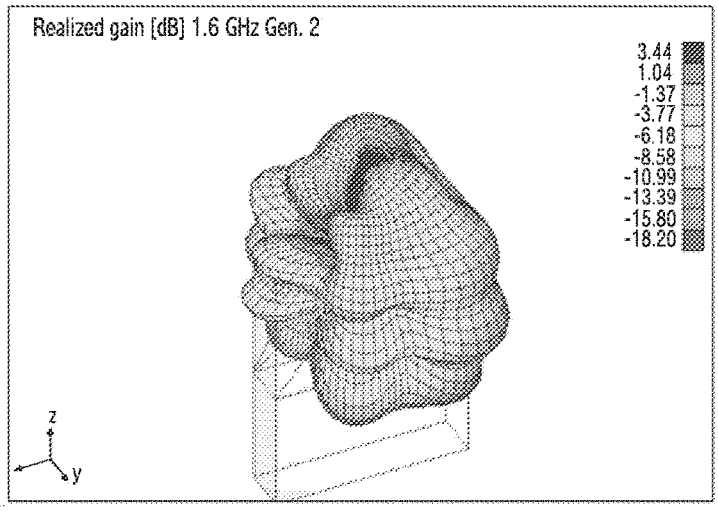
FIG. 21C illustrates 2-element array antenna in three rows according to an embodiment of the disclosure.

FIG. 21C illustrates the 2-element array antenna in the three rows according to an embodiment of the disclosure.

Referring to FIGS. 21A, 21B, and 21C, the 2-element array antenna is disposed most compactly in three rows in a mobile device.

Referring to FIGS. 21A, 21B, and 21C, the 2-element array antenna exhibits the similar radiation pattern to a general patch array antenna, and the proposed antenna shape may be disposed compactly inside a mobile device platform. According to various embodiments of the disclosure, up to six elements may be disposed.

An apparatus according to various embodiments of the disclosure includes an array antenna in which a plurality of antenna elements is very contiguous, thus minimizing interference and realizing the small array antenna including the contiguous antenna elements.

The method according to the embodiment may be embodied in the form of program instructions which may be executed by various computer means and recorded in a computer readable medium. The computer readable medium may include program instructions, data files, data structures, and the like, alone or in combination. The program instructions recorded on the media may be those specially designed and constructed for the purposes of the embodiments, or they may be of the kind well-known and available to those having skill in the computer software arts. Examples of the computer readable recording media include magnetic media such as hard disks, floppy disks and magnetic tape, optical media such as compact disc (CD)-read only memories (ROMs), digital versatile discs (DVDs), and magneto-optical media disks such as floppy disks, and hardware devices specifically configured to store and execute program instructions, such as ROM, random access memory (RAM), flash memory, and the like. Examples of program instructions include not only machine code generated by a compiler, but also high-level language code which may be executed by a computer using an interpreter or the like. The hardware device described above may be configured to operate as one or more software modules to perform the operations of the embodiments, and vice versa.

Although the embodiments have been described by the limited embodiments and the drawings as described above, various modifications and variations are possible to those skilled in the art from the above description. For example, the described techniques may be performed in a different order than the described method, and/or components of the described systems, structures, devices, circuits, etc. may be coupled or combined in a different form than the described method, or an appropriate result may be achieved even if replaced or substituted by other components or equivalents.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An array antenna comprising:

a first antenna operating in a first mode;

a second antenna operating in a second mode;

a first weight multiplier for multiplying a signal received using the first antenna by a first weight;

a second weight multiplier for multiplying a signal received using the second antenna by a second weight; and an array antenna receiver for calculating a received signal of the array antenna by adding the signal multiplied by the first weight and the signal multiplied by the second weight, wherein a correlation between an electric field of the first mode and an electric field of the second mode falls below a first threshold which is predetermined, or a correlation between a magnetic field of the first mode and a magnetic field of the second mode falls below a second threshold which is predetermined, and wherein the first weight and the second weight are updated based on an Equation, $$\overline{w}_{k+1}=\overline{w}_k-2\cdot\mu\cdot(\overline{r}_{xd})_k+2\cdot\mu\cdot(\overline{R}_{xx})\cdot\overline{w}_k$$

where $\overline{w}_{k+1}$ is a weight vector of a (k+1)-th iterative calculation, $\overline{w}_k$, is a weight vector of a k-th iterative calculation, the weight vector comprises, as an element, a weight multiplied by the signal received using each antenna, $\mu$ is an adaptive gain value and is a constant greater than 0 and smaller than 1, $(\overline{r}_{xd})_k$ is a cross correlation matrix of a received signal vector $\overline{x}_k$ and a reference signal $d_k$ in the k-th iterative calculation, and $(\overline{R}_{xx})_k$ is a covariance matrix of the received signal vector $\overline{x}_k$ in the k-th iterative calculation.

2. The array antenna of claim 1, wherein the first antenna is a monopole antenna, and wherein the second antenna is a patch antenna of a loop shape.

3. The array antenna of claim 2, wherein the first antenna is connected to a first feed port by penetrating a dielectric, and wherein the second antenna is disposed in contact with a bottom surface of the dielectric and is connected to a second feed port.

4. The array antenna of claim 3, wherein the dielectric contacts a substrate on a top surface.

5. The array antenna of claim 3, wherein the first antenna and the second antenna share ground, and wherein the first feed port and the second feed port penetrate the ground, are spaced apart from each other, and protrude from a bottom side of the ground.

6. The array antenna of claim 2, wherein the first antenna is extended from a center of the patch antenna, perpendicularly to a plane covering the patch antenna.

7. The array antenna of claim 1, wherein phase centers of the first antenna and the second antenna are in parallel on an axis vertical to the second antenna.

8. The array antenna of claim 1, wherein the first antenna and the second antenna are different modals.

9. The array antenna of claim 1, wherein the electric field of the first mode and the electric field of the second mode are orthogonal, or wherein the magnetic field of the first mode and the magnetic field of the second mode are orthogonal.

* * * * *